US005411830A

United States Patent [19]

Matsunaga

[11] Patent Number: 5,411,830

[45] Date of Patent: May 2, 1995

[54] MAGNETIC DEVELOPER, ELECTROPHOTOGRAPHIC APPARATUS AND RECOGNITION METHOD OF MAGNETIC INK CHARACTER

[75] Inventor: Satoshi Matsunaga, Tokyo, Japan

[73] Assignee: Canon Kabushiki Kaisha, Tokyo, Japan

[21] Appl. No.: 736,633

[22] Filed: Jul. 26, 1991

[30] Foreign Application Priority Data

| | | | |
|---|---|---|---|
| Jul. 27, 1990 | [JP] | Japan | 2-199751 |
| Jul. 27, 1990 | [JP] | Japan | 2-199752 |
| Oct. 4, 1990 | [JP] | Japan | 2-265037 |
| Oct. 4, 1990 | [JP] | Japan | 2-265038 |
| Oct. 4, 1990 | [JP] | Japan | 2-265043 |

[51] Int. Cl.[6] ..... G03G 9/083

[52] U.S. Cl. ..... 430/166.6; 430/111; 252/67.54

[58] Field of Search ..... 430/106.6, 111

[56] References Cited

U.S. PATENT DOCUMENTS

| | | | |
|---|---|---|---|
| 4,517,268 | 5/1985 | Gruber et al. | 430/39 |
| 4,820,603 | 4/1989 | Sakashita | 430/106.6 |
| 4,919,727 | 4/1990 | Burow et al. | 106/456 |
| 5,002,751 | 3/1991 | Wiese et al. | 423/632 |
| 5,127,952 | 7/1992 | Persello et al. | 106/492 |

FOREIGN PATENT DOCUMENTS

| | | |
|---|---|---|
| 173910 | 3/1986 | European Pat. Off. . |
| 247884 | 12/1987 | European Pat. Off. . |
| 266247 | 5/1988 | European Pat. Off. . |
| 312977 | 5/1989 | European Pat. Off. . |
| 327923 | 8/1989 | European Pat. Off. . |
| 427199 | 5/1991 | European Pat. Off. . |
| 59-7379 | 2/1984 | Japan . |
| 59-204846 | 11/1984 | Japan . |
| 63-108354 | 5/1988 | Japan . |

OTHER PUBLICATIONS

Patent Abstracts of Japan, vol. 12, No. 219 (C-506) [3066 , Jun. 22, 1988.

*Primary Examiner*—Christopher D. Rodee

*Attorney, Agent, or Firm*—Fitzpatrick, Cella, Harper & Scinto

[57] ABSTRACT

A magnetic developer including magnetic toner particles is formed from a magnetic material containing silicon preferably in an amount of 0.1–1.0 wt. % calculated as $SiO_2$ and aluminum preferably in an amount of 0.1–1.0 wt. % calculated as $Al_2O_3$, respectively based on the magnetic material. The magnetic developer thus produced has both a large triboelectric charge and a sharp distribution of triboelectric charge and is suitable for developing digital latent images by a reversal development scheme. The magnetic developer also has appropriate levels of residual magnetization and coercive force, and characters printed therewith are suitable for magnetic ink character recognition.

22 Claims, 3 Drawing Sheets

MAGNETIC DEVELOPER, ELECTROPHOTOGRAPHIC APPARATUS AND RECOGNITION METHOD OF MAGNETIC INK CHARACTER

FIELD OF THE INVENTION AND RELATED ART

The present invention relates to a magnetic developer for use in electrophotography, electrostatic printing, electrostatic recording, etc., an apparatus unit containing the magnetic developer, an electrophotographic apparatus and a magnetic ink character recognition method using the magnetic developer.

The present invention further relates to a magnetic developer for use in an electrophotographic image forming method wherein a digital latent image composed of pixels each forming ON-OFF binary levels or a limited number of gradation levels is developed by a reversal development scheme, an apparatus unit containing the magnetic developer and an electrophotographic apparatus using the magnetic developer.

In a conventional electrophotographic system, an original image is exposed to light, and reflected light therefrom is used to irradiate a latent image-holding member to form a latent image thereon. In the system, reflected light from an original is directly used as an image signal to result in an electric latent image having a continuously changing potential (hereinafter called an "analog latent image").

In another recently commercialized system, reflected light from an original is converted into electric signals, which are then processed, and exposure is effected based on the processed signals. This system facilitates a higher degree of enlargement or reduction in size than in the conventional system using an analog latent image and allows processing of the image signals together with other data in a computer to produce an output. This system allows for various usages as described above but, on the other hand, requires a digital conversion process of dividing an image into unit pixels (hereinafter called "dot(s)") and determining an exposure quantity for each dot since an enormous amount of signals must be handled if the image signals are handled without such a digital conversion process.

In the case of using such a digitalized latent image, each dot is required to be exactly developed than in the case of an analog latent image, so that it is necessary to use a developer capable of faithfully developing a pixel at a high development rate.

In the case of developing a digital latent image, a larger deviation in latent image surface potential results at the time of latent image formation than in the case of an analog latent image, and it is necessary to effect a satisfactory development of even a latent image part having a small potential difference between a developer-carrying member and a latent image-holding member such as a photosensitive drum.

The developing performance of a developer plays a particularly significant role for an image comprising image dots and non-image dots alternating dot by dot. As a result, in case where an analog latent image developer is used in a digital latent image development system, there is encountered a difficulty that development of respective dots becomes insufficient particularly in such an image pattern comprising alternating image and non-image dots to result in a reduction in size of dots or development failure of dots, thus tending to provide a thinner image density as a whole or scratchy character. Such a difficulty is noticeable particularly for a magnetic developer (i.e., a developer comprising a magnetic toner containing a magnetic material) which is liable to have an insufficient charge.

This is presumably because a magnetic material is exposed at some surface parts of magnetic toner particles in the magnetic toner to result in a decrease in surface area available for charging. The surface exposure rate of a magnetic material varies with the amount of the magnetic material contained in one magnetic toner particles, so that the charge distribution of the magnetic developer becomes broader than that of another developer comprising non-magnetic toner particles.

Accordingly, in a digital latent image development system using a magnetic developer, scratchy characters are liable to be formed due to accumulation in a developing apparatus of magnetic toner particles with insufficient triboelectric charges, and thus a solution thereof has been desired.

Further, along with the development of image forming apparatus inclusive of electrophotographic copying apparatus in recent years, the usage of the image forming apparatus is diversified and, on such a background, a character printing apparatus for use in a Magnetic Ink Character Recognition (hereinafter abbreviated as "MICR") system has been developed as an application of an electrophotographic printer.

More specifically, MICR system is a system in which data, such as bank of issue, amount of money and account number, are printed with a magnetic ink or securities, such as checks and bills, so that such securities are effectively classified and journalized by using a magnetic reader. Hitherto, offset printing using a magnetic ink has been mainly used for the printing. As trading using personal checks or bills becomes active in recent years, there has been an increasing demand for a compact printer for printing MICR characters (hereinafter called an "MICR encoder").

A conventional compact MICR encoder has been principally an impact printer utilizing thermal transfer, which however has a single function of printing MICR characters and cannot be used for preparation of ordinary documents, thus leaving room for improvement.

Under these circumstances, an electrophotographic printer capable of printing for preparation of ordinary documents and/or graphics and also capable of printing MICR characters providing a high MICR recognition rate is desired.

On the other hand, in case where an electrophotographic printer is used as an MICR encoder, the use of a conventional magnetic developer as it is results in a much lower and non-practical recognition rate (higher error rate) by an MICR reader-sorter as compared with those of conventional MICR characters given by offset printing or impact printers.

Securities or bills having MICR characters are passed about ten times on an average through an MICR reader-sorter and, at each time of passage for magnetic recording, the characters are rubbed at a high rate with a magnetic head. Accordingly, MICR characters given by a magnetic developer for that purpose must not be scratched or blurred due to such rubbing.

As for MICR characters, there is, e.g., a standard called E-13B prescribed by ANS (American National Standard) x9.27-198x or JIS C6251-1980. According to the E-13B standard, MICR characters are composed of numerals of 0–9 and 4 types of symbols, and combinations of these numerals and symbols are used for expressing data, such as bank code, account number, and amount of money, on securities, bills, etc.

MICR characters are required to be printed with accurate reproduction of shape and size so as to provide a good recognition rate. Accordingly, the characters should be reproduced finely and faithfully without resolution failure or blur.

In order to accomplish a high recognition rate with MICR characters given by an electrophotographic printer, it is necessary to use a magnetic developer capable of reproducing characters at a high accuracy. Further, it is desirable to use a magnetic developer containing a specific material which shows magnetic properties different from those of a magnetic material used in a conventional magnetic developer. Thus, it is necessary to use a magnetic developer having high developing performances to provide an excellent thin line reproducibility. Further, a magnetic material showing a relatively large residual magnetization $\sigma_r$ is desired.

Further, a magnetic toner for MICR is required to show a good triboelectric chargeability and a uniform applicability onto a developer-carrying member (hereinafter called a "sleeve) of a developing apparatus likewise an ordinary magnetic developer for electrophotographic printers. In order to satisfy these requirements, the shape and permeability of the magnetic material contained in the magnetic developer also constitute important factors.

Japanese Patent Publication (JP-B) 59-7379 has proposed a magnetic toner which contains cobalt-substituted magnetite powder having a long axis/short axis ratio of 1–5 and has a residual magnetization of 10–20 emu/g and a coercive force of 150–450 Oersted. When the magnetic toner is used for forming an image, however, it has been found difficult to uniformly apply a toner layer on a sleeve, thus resulting in inferior triboelectric chargeability and images with low density and inferior clarity.

Japanese Laid-Open Patent Application (JP-A) 63-108354 has proposed an insulating magnetic capsule toner containing spherical magnetic powder having a long axis/short axis ratio of 1–1.5 and a permeability of 3.80–6.00. JP-A 59-204846 has proposed a magnetic toner containing ferromagnetic fine powder having a maximum permeability of 3.95–5.50. These toners are preferred in that they provide a high image density, but they leave room for further improvement in respects of resolution and applicability to the reversal development scheme.

SUMMARY OF THE INVENTION

A generic object of the present invention is to provide a magnetic developer having solved the above-mentioned problems, an apparatus unit containing the magnetic developer, and an electrophotographic apparatus using the magnetic developer.

A more specific object of the present invention is to provide a magnetic developer having a large triboelectric chargeability.

Another object of the present invention is to provide a magnetic developer having good thin-line reproducibility and resolution and suitable for use in development of digital latent images.

Another object of the present invention is to provide a magnetic developer capable of provide an increased image density.

An object of the present invention is to provide a magnetic developer capable of forming toner images with excellent resolution, gradation and thin-line reproducibility even in an image forming apparatus wherein a latent image is formed by digital image signals and the latent image is developed by the reversal development scheme.

Another object of the present invention is to provide a magnetic toner having a narrower distribution of triboelectric charge and a larger triboelectric charge.

Another object of the present invention is to provide a magnetic developer capable of providing MICR (Magnetic Ink Character Recognition) characters showing an excellent recognition rate when used in an MICR system utilizing an electrophotographic printer.

Another object of the present invention is to provide a magnetic developer capable of providing characters which do not cause a decrease in recognition rate even on repetitive passage through an MICR reader-sorter.

Another object of the present invention is to provide a magnetic developer excellent in thin-line reproducibility and resolution and capable of providing MICR characters which can be faithfully reproduced according to the standard thereof.

Another object of the present invention is to provide a magnetic developer capable of providing clear images free of fog and MICR characters free from a lowering in recognition rate.

Another object of the present invention is to provide a magnetic developer capable of providing MICR images free of blur or scratch even on passage through an MICR reader-sorter.

Another object of the present invention is to provide a magnetic developer which can be uniformly applied onto a developing sleeve and provide high-density images free of density irregularity.

Another object of the present invention is to provide a magnetic developer which shows a good interaction with a permanent magnet within a developing sleeve and shows an appropriately controlled triboelectric charge.

Another object of the present invention is to provide a magnetic developer which can be applied uniformly onto a developing sleeve and comprises a magnetic toner containing a magnetic material uniformly dispersed therein to have uniform magnetic properties and triboelectric chargeability.

A further object of the present invention is to provide an apparatus unit containing such a magnetic developer as described above, an electrophotographic apparatus using the magnetic developer and a magnetic ink character recognition method using the magnetic developer.

According to the present invention, there is provided a magnetic developer, comprising: magnetic toner particles comprising a magnetic material containing silicon and aluminum.

According to another aspect of the present invention, there is provided an apparatus unit, comprising: a single unit disposed connectable to or releasable from an apparatus body as desired said single unit being formed by integrally supporting an electrostatic image-holding member for holding an electrostatic image thereon, and at least one member selected from the group consisting of a charging means for charging the surface of the electrostatic image-holding member, a developing means for developing the electrostatic image, and a cleaning means disposed abuttable to the surface of the electrostatic image holding member to clean the surface;

wherein the developing means comprises a magnetic developer comprising magnetic toner particles comprising a magnetic material containing silicon and aluminum.

According to still another aspect of the present invention, there is provided an electrophotographic apparatus, comprising:

an electrostatic image-holding member for holding an electrostatic image thereon, a charging means for charging the surface of the electrostatic image-holding member, a latent image-forming means for forming an electrostatic image on the electrostatic image-forming member, a developing means for developing the electrostatic image, and a transfer means for transferring the developed image onto a transfer-receiving medium;

wherein said developing means comprises a magnetic developer comprising magnetic toner particles comprising a magnetic material containing silicon and aluminum.

According to a further aspect of the present invention, there is provided a recognition method of magnetic ink character, comprising:

printing a magnetic ink character with a magnetic developer on a recording medium, magnetizing the printed ink character, and reading and discriminating the magnetized magnetic ink character, wherein the magnetic developer comprises a magnetic developer comprising magnetic toner particles comprising a magnetic material containing silicon and aluminum.

As a result of my study, it has been found that the use of a magnetic material containing silicon and aluminum in magnetic toner particles constituting a magnetic developer causes the magnetic developer to have an enhanced triboelectric chargeability and a sharper distribution of triboelectric charge.

The magnetic developer thus provided has an improved reproducibility of faithfully reproducing a latent image formed on a photosensitive member including thin lines as well as dot images such as halftone dots or digitalized dots to provide images with excellent gradation and resolution.

Further, the magnetic developer according to the present invention, when used in printing of MICR characters, produces such characters which provide a good recognition rate and are free of scratch or blur even on repetitive passage through an MICR reader-sorter to retain the good recognition rate.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
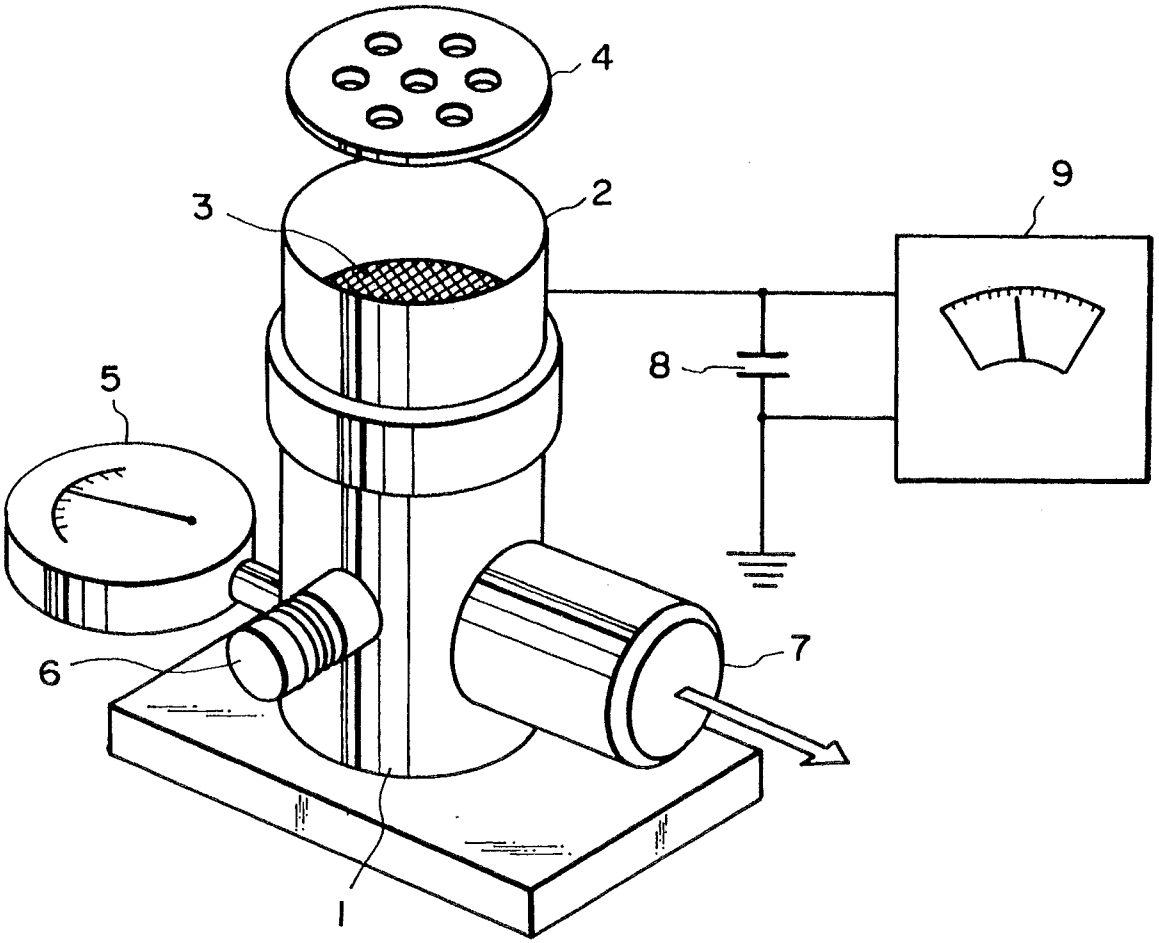
FIG. 1 is an illustration of an instrument for measuring triboelectric charges of a magnetic developer and silica fine powder.

The magnetic material in the magnetic developer according to the present invention may preferably contain silicon in a proportion of 0.1–1.0 wt. %, more preferably 0.15–0.9 wt. %, respectively calculated as $SiO_2$ with respect to the weight of the magnetic material. Further, the magnetic material may preferably contain aluminum in a proportion of 0.1–1.0 wt. %, more preferably 0.15–0.9 wt. %, respectively calculated as $Al_2O_3$ with respect to the weight of the magnetic material.

The silicon content and aluminum content may be added to the magnetic material during and/or after the wet process for synthesis of the magnetic material, or may be added in a stage of oxidation and/or reduction under heating after the wet synthesis in case where such an additional stage is included.

If the silicon content calculated as $SiO_2$ in the magnetic material is below 0.1 wt. % of the magnetic material, the resultant magnetic developer may have a large triboelectric chargeability but is also caused to have a broad distribution of triboelectric charge, thus being liable to cause a change in triboelectric chargeability due to a change in environmental conditions, such as temperature and humidity. On the other hand, if the silicon content calculated as $SiO_2$ in the magnetic material exceeds 1.0 wt. % of the magnetic material, a narrow distribution of triboelectric charge is obtained but it is difficult to obtain a magnetic developer having a large triboelectric charge.

Thus, if the magnetic material having a silicon content calculated as $SiO_2$ in the range of 0.1 –1.0 wt. % based on the weight of the magnetic material is used, it is possible to obtain a magnetic developer having a larger triboelectric chargeability, a sharper distribution of triboelectric charge, and thus improved developing performances.

If the aluminum content calculated as $Al_2O_3$ in the magnetic material is below 0.1 wt. %, it is difficult to obtain a magnetic developer having a large triboelectric chargeability. If the aluminum content calculated as $Al_2O_3$ in the magnetic material exceeds 1.0 wt. % of the magnetic material, a magnetic developer having a large triboelectric chargeability can be obtained but the magnetic developer tends to have a broad distribution of triboelectric charge, so that even a non-image part on a photosensitive member can be developed to provide a foggy image, and thus it is difficult to obtain a magnetic developer with excellent thin-line reproducibility and gradation characteristic.

As a result, if a magnetic material having an aluminum content calculated as $Al_2O_3$ of 0.1–1.0 wt. % based on the weight of the magnetic material is used, it is possible to obtain a magnetic developer having a sharper distribution of triboelectric charge, a larger triboelectric chargeability, and thus improved developing performances.

In the magnetic material used in the present invention, it is preferred that the silicon content calculated as $SiO_2$ and the aluminum content calculated as $Al_2O_3$ are in the weight ratio range of 1:20–20:1, more preferably 1:10–10:1, further preferably 1:4–4:1.

If the silicon/aluminum ratio exceeds 20:1, the effect of providing an increased image density given by the aluminum content becomes scarce. On the other hand, if the ratio is lower than 1:20 providing an excessive aluminum content, the magnetic material obtained through a wet process is liable to sinter under heating for oxidation or reduction.

As a result, if the magnetic material has a silicon-/aluminum ratio in terms of $SiO_2/Al_2O_3$, it shows a large effect of providing an increased image density and is free from or less liable to cause sintering during its production process.

The magnetic material containing silicon and aluminum used in the present invention may be synthesized through a wet process using ferrous sulfate as a starting material and by addition of, e.g., sodium silicate and, e.g., aluminum hydroxide during the synthesis reaction and/or after the synthesis reaction.

The magnetic material thus produced and used in the present invention may preferably have a residual magnetization $\rho_r$ satisfying $12 \leqq \rho_r \leqq 30$ emu/g, further preferably $14 \leqq \rho_r \leqq 28$ emu/g, for a magnetic field of 10,000 Oersted.

If the residual magnetization $\rho_r$ is below 12 emu/g, the resultant magnetic developer tends to provide MICR characters showing a lower recognition rate by an MICR reader-sorter when used in an MICR system and tends to fail in showing excellent thin-line reproducibility and gradation characteristic in ordinary printing.

In case where the residual magnetization $\rho_r$ exceeds 30 emu/g, the resultant magnetic developer tends to provide a low image density and fog, so that a lower recognition rate is liable to be given in case of MICR character printing, and a lower image quality is liable to be given in case of ordinary printing.

The magnetic material used in the present invention may preferably have a coercive force Hc satisfying $130 \leqq Hc \leqq 300$ Oersted, further preferably $150 \leqq Hc \leqq 280$ Oersted, after magnetization under a magnetic field of 10,000 Oersted.

If the coercive force is below 130 Oersted, a higher image density can be obtained but a lower thin-line reproducibility is liable to be given to provide MICR characters showing a lower recognition rate. In case where the coercive force Hc exceeds 300 Oersted, it becomes difficult to uniformly apply the resultant magnetic developer onto a developing sleeve, thus tending to cause a decrease in image density or a density irregularity.

According to my study, it has been found that a magnetic material having a relatively large residual magnetization $\rho_r$ shows a good correlation between its permeability $\mu$ and developing performance of the resultant magnetic developer. It has been further found that the permeability $\mu$ shows a good correlation with an error rate in reading of MICR characters by an MICR reader-sorter.

The magnetic material used in the present invention may preferably have a permeability $\mu$ satisfying a range of $2.0 \leqq \mu \leqq 4{,}0$, further preferably $2.5 \leqq \mu \leqq 3.8$.

In case where the permeability $\mu$ exceeds 4.0, the resultant magnetic develop can be uniformly applied onto a developing sleeve but shows only a weak interaction with a permanent magnet in the developing sleeve, thus giving rise to a difficulty in appropriate control of the triboelectric charge of the magnetic developer, so that toner scattering is liable to occur at the image part and a lower recognition rate is liable to be given in case of MICR character printing.

In case where the permeability $\mu$ is below 2.0, the resultant magnetic developer causes an excessively strong interaction with the permanent magnet in the developing sleeve, so that it becomes difficult to appropriately control the triboelectric charge of the magnetic developer to result in a lower image density and, in case of MICR character printing, a lower recognition rate is liable to result.

A magnetic material having strong magnetic properties like one represented by a residual magnetization of 12–30 emu/g and a coercive force of 130–300 Oersted, respectively for a magnetic field of 10,000 Oersted as used in the present invention, tends to show a decrease in developing efficiency onto an electrostatic charge image-holding member because it is attached to the developing sleeve under the action of a strong magnet force exerted by the magnetic within the developing sleeve. The magnetic material used in the present invention containing both silicon and aluminum provides a magnetic developer having an improved triboelectric chargeability and a sharper distribution of triboelectric charge to provide enhanced developing performances, which can compensate for the decrease in developing efficiency caused by the use of a magnetic material having strong magnetic properties.

The magnetic properties inclusive of a residual magnetization of 12–30 emu/g and a coercive force of 130–300 Oersted, respectively for a magnetic field of 10,000 Oersted, and a permeability of 2.0–4.0 given by the magnetic material used in the present invention, are higher than those of an ordinary magnetic material used in ordinary magnetic developers for electrophotography and cannot be provided by an ordinary magnetic material obtained from an ordinary wet process using ferrous sulfate as a starting material.

Such a magnetic material having high magnetic properties may preferably be prepared by oxidizing a magnetic material obtained through an ordinary wet process at a high temperature such as 600°–900° C. in an oxygen-containing atmosphere, such as air, into $\alpha$-$Fe_2O_3$, and then moderately reducing the $\alpha$-$Fe_2O_3$ at a lower temperature of 250°–450° C. in a gaseous mixture of hydrogen with an inert gas such as nitrogen.

The magnetic properties of magnetic materials referred to herein are based on values measured by using a tester ("VSMP-1" mfd. by Toei Kogyo K.K.). In such a measurement, a sample magnetic material in an amount of 0.1–0.15 g is accurately weighed by using a directly indicating balance having a sensitivity of about 1 mg, and the measurement of the magnetic properties may be performed at 25° C. by drawing a hysteresis loop with a sweeping time of 10 minutes under an external magnetic field of 10,000 Oersted.

The magnetic material used in the magnetic developer according to the present invention may preferably have a packed apparent density (or packed bulk density) of 1.2–2.58 g/cm$^3$, more preferably 1.3–2.0 g/cm$^3$, and a linseed oil absorption of 5–30 ml/100 g, more preferably 10–28 ml/100 g.

The packed apparent density of 1.2–2.5 g/cm$^3$of the magnetic material is such a large value that cannot be satisfied by an ordinary untreated magnetic material. The magnetic material having the above-described packed apparent density and linseed oil absorption may be prepared by disintegrating a magnetic material. The disintegration of a magnetic material may be performed, for example, by a mechanical pulverizer having a high-speed rotor for powder disintegration, or by a pressure disperser having a load roller for powder dispersion or disintegration.

In case where a mechanical pulverizer is used for disintegrating agglomerates of a magnetic material, an impact force exerted by the rotor is liable to be applied also to primary particles of the magnetic material to break the primary particles per se and result in fine powder of the magnetic material. When such a magnetic material disintegrated by a mechanical pulverizer is used as a material of a toner, the triboelectric chargeability of the toner is deteriorated due to the presence of fine powder of the magnetic material. Accordingly, a decrease in toner image density is likely to occur due to the decrease in triboelectric charge of the toner.

In contrast thereto, a pressure disperser, such as a fret mill, equipped with a load roller is further preferred in respect of efficiency of disintegration of agglomerates of the magnetic material and suppressed formation of fine powdery magnetic material.

The packed apparent density and the oil absorption of the magnetic material may be understood to indirectly indicate the shape and surface state of the magnetic material and also the degree of presence of agglomerates thereof. A packed apparent density of below 1.2 g/cm$^3$ of the magnetic material indicates a dominant presence of agglomerates of the magnetic material and substantial insufficiency of the disintegration treatment. As a result, if a magnetic material having a packed apparent density of below 1.2 g/cm$^3$ is used, the magnetic material is not readily dispersed uniformly in the binder resin, and such ununiform distribution of the magnetic material tends to provide a lower recognition rate in the case of MICR character printing.

A packed apparent density of above 2.5 g/cm$^3$ of the magnetic material indicates an excessive degree of disintegration of agglomerates of the magnetic material, which promotes the sticking of powder of the magnetic material under pressure to result in pellets of the magnetic material. This also tends to provide a difference in contact of the magnetic material in individual magnetic toner particles, leading to a lower recognition rate in the case of MICR character printing.

Similar difficulties are likely to be encountered also when the linseed oil absorption of the magnetic material is below or above the above described range.

The packed apparent density data of magnetic materials referred to herein are based on values measured by using a Powder Tester and the accompanying vessel (available from Hosokawa Micron K.K.) and according to the handing manual for the Powder Tester.

The linseed oil absorption data of magnetic materials described herein are based on values measured according to JIS K5101-1978 (pigment test method).

According to may study, it is expected that a magnetic material having a larger residual magnetization $\rho_r$ than a conventional magnetic material as described above while provide a larger fluctuation in magnetic property for individual particles of magnetic material.

On the other hand, in the case of a magnetic developer, it has been known that the content of magnetic material can vary according to the particle size of the magnetic developer particles. In other words, there is a possibility that different sizes of magnetic developer particles have different magnetic properties.

Accordingly, in the case of a magnetic developer required to strictly satisfy a magnetic property like that of the present invention, it is preferred to control the state of presence of the magnetic material in the binder resin. This means that not only a simple uniform dispersion of the magnetic material in the binder resin but also the packing state of the magnetic material is important.

I have found that the packing state of a magnetic material in a binder resin is strongly affected by the particle size distribution of the magnetic material.

It has been found that the magnetic material used in the present invention provides a preferred packing state as described above when it has a specific range of variation coefficient as a measure of particle size distribution. Herein, the variation coefficient of a magnetic material is a value calculated by the following equation:

$$\text{Variation coefficient} = (\rho\bar{x}) \times 100,$$

where $\bar{x}$ denotes the average particle size of the magnetic material, and $\rho$ denotes the standard deviation of the particle size distribution.

Further, in order to provide a magnetic developer having a further improved thin-line reproducibility and capable of providing clearer line images, it is raised as a solution to provide a narrower charge distribution.

It has been heretofore known to uniformly disperse a magnetic material as an effective means for providing a magnetic developer with a narrower charge distribution. In the case of a magnetic material containing silicon and aluminum at the surface or within the interior (preferably in specific properties) like that of the present invention, it is not necessary to effect such a uniform dispersion.

According to my study, it has been found that a magnetic developer having a narrower charge distribution as well as magnetic properties can be provided in case where the magnetic material used in the present invention has a specific range of variation coefficient.

The magnetic material used in the present invention may preferably have a variation coefficient as defined above of 20–50 %, further preferably 25–45%. A variation coefficient of below 20% provides a uniform and preferable dispersion state of magnetic material in a magnetic developer for an ordinary magnetic material but tends to cause ununiform application of magnetic developer on a developing sleeve and a lower uniformity of triboelectric charge for the magnetic material having high magnetic properties used in the present invention according to my study. On the other hand, a variation coefficient of above 50% tends to result in a lower uniformity of dispersion state of the magnetic material within the magnetic developer and lower uniformity of magnetic properties such as residual magnetization and triboelectric chargeability of the magnetic developer.

A variation coefficient of 20–50% may be obtained by controlling the above-mentioned disintegration conditions.

The magnetic material used in the present invention may preferably have a specific surface area of 5.0–13.0 m$^2$/g, further preferably 6.0–10.0 m$^2$/g, as measured by the BET method using nitrogen gas absorption.

The measurement of the specific surface area according to the BET method using nitrogen gas absorption may be performed by using a commercially available apparatus (such as "Autosorb 1", mfd. by Quantum Chemicals, Co.).

The BET specific surface area and the average particle size may generally have a good correlation with each other. Accordingly, the magnetic material used in the present invention may preferably have an average particle size of 0.1–0.6 micron, more preferably 0.15–0.4 micron. The average particle size values of magnetic materials referred to herein are based on values measured by tacking an enlarged photograph of a sample magnetic materials at a magnification of 20,000 through a scanning electron microscope and calculating an average of longer axis sizes of 100–200 particles taken at random in the photograph. A long axis/short axis ratio may be obtained by simultaneously measuring the shorter axis sizes.

The magnetic material used in the present invention may preferably have a long axis/short axis ratio in the range of 1.0–1.5, more preferably 1.0–1.4.

In case where the magnetic material used in the present invention has an average particle size of below 0.1 micron, the magnetic material is caused to have a poor dispersibility in the binder resin to make it difficult to provide a uniform chargeability of the magnetic developer or to provide the magnetic developer with a remarkably increased shear modulus around a fixation temperature, thus resulting in poor fixability.

In case where the magnetic material has an average particle size exceeding 0.6 micron, the magnetic material cannot be dispersed uniformly in the binder resin, so that the magnetic developer fails to have a uniform chargeability and also remarkably damages the photosensitive member surface.

In case where the magnetic material has a long axis/short axis ratio outside the range of 1.0–1.5, the attachment state of the magnetic developer on the developing sleeve tends to be instable, thus resulting in lower developing characteristics and lower image densities. The shapes of magnetic material providing a long axis/short axis ratio in the range of 1.0–1.5 may include: sphere, hexahedron and octahedron, and the shape of magnetic material providing a ratio of above 1.5 may for example be a needle.

The magnetic developer of the present invention may preferably have a triboelectric charge of −5 to −20 μC/g. A triboelectric charge of below −5 μC/g is liable to provide a lower image density. A triboelectric charge exceeding −20 μC/g leads to a so-called charge-up phenomenon that the charge of a toner in the vicinity of the sleeve is caused to have a larger charge on repetitive image formation to hinder appropriate charging of the toner supplied thereto, thus resulting in a gradual decrease in image density. This phenomenon is liable to occur in development of digital latent images, i.e., dot latent images, and is noticeable in reversal development of low-potential contrast images on an OPC photosensitive member.

The magnetic toner of the present invention is substantially electrically insulating so as to have a triboelectric charge. More specifically, the magnetic toner may preferably have a resistivity of at least $10^{14}$ ohm.cm under application of a voltage of 100 V and a pressure of 3.0 kg/cm$^2$.

The magnetic material used in the present invention may preferably be contained in an amount of 50–140 wt. parts, particularly 60–120 wt. parts, per 100 wt. parts of the binder resin. If the amount is below 50 wt. parts, the magnetic toner tends to show a lower conveyability on the developer-carrying member, such as a sleeve. If the amount exceeds 140 wt. parts, the magnetic toner tends to cause a decrease in insulating property and thermal fixability.

The magnetic material used in the present invention may preferably be synthesized in a wet process using an aqueous solution containing $Fe^{2+}$, e.g., a solution of ferrous sulfate, followed by oxidation and reduction at a temperature of at least 200° C.

The triboelectric charge of a toner may be measured in the following manner.

1 g of a sample toner and 9 g of carrier iron powder not coated with a resin having a mode particle size of 200 to 300 mesh (e.g. EFV 200/300, produced by Nippon Teppun K.K.) are mixed thoroughly in a 50 cc polyethylene bottle having a cap in an environment of 23° C. and 60% RH by shaking the pot in hands vertically about 100 times for about 20 sec).

Then, about 0.5 g of the shaken mixture is charged in a metal container 2 for measurement provided with 400-mesh screen 3 at the bottom as shown in FIG. 1 and covered with a metal lid 4. The total weight of the container 2 is weighed and denoted by $W_1$ (g). Then, an aspirator 1 composed of an insulating material at least with respect to a part contacting the container 2 is operated, and the toner in the container is removed by suction through a suction port 7 sufficiently for about 1 minute until the potential is saturated while controlling the pressure at a vacuum gauge 5 at 250 mm$H_2O$ by adjusting an aspiration control valve 6. The reading at this time of a potential meter 9 connected to the container by the medium of a capacitor having a capacitance C (μF) is denoted by V (volts.). The total weight of the container after the aspiration is measured and denoted by $W_2$ (g). Then, the triboelectric charge Q (μC/g) of the toner is calculated as: $Q=C\times V/(W_1-W_2)$.

The values of permeability μ of magnetic materials described herein are, more specifically, those of effective specific permeability. The measurement may be performed by using a toroidal core uniformly wound up with a coil and measuring an inductance change at that time.

More specifically, about 15 g of a sample magnetic material is well mixed with 2.5 ml of an aqueous binder resin solution (5–10 wt. % polyvinyl alcohol) and the mixture is charged in a ring-shaped mold and shaped under a pressure of about 1 ton/cm$^2$. It is important to form a constant-density sample (for the magnetic material excluding the binder resin) in order to acquire a measured value at a good reproducibility.

Then, the toroidal sample is wound by several tens turns of a coil to form a sample, the permeability of which may be obtained by measuring a tuning capacitance by using an impedance gain phase analyzer (e.g., one available from Yokogawa Hewlett-Packard K.K.).

The effective specific permeability μ may be calculated based on the following definition:

$$\mu=L/L_0,$$

wherein $L_0$ denotes the inductance of the coil in the absence of the toroidal sample and L denotes the inductance of the coil with the toroidal sample inserted. The inductance $L_0$ with no sample is given by the following equation:

$$L_0=\mu_0 AN^2/l.$$

Accordingly, the effective specific permeability $\mu$ is given by the following equation based on the measured value L (inductance of the coil with the inserted toroidal sample):

$$\mu = IL/(\mu_0 A N^2),$$

wherein $\mu_0$ denotes the permeability of vacuum ($4\pi \times 10^{-7}$), A denotes the sectional area of the sample, N denotes the number of turns of the coil and I denotes the average magnetic path length of the sample.

The silicon content of the magnetic material used in the present invention may be measured in the following manner. About 0.5–1 g of a sample magnetic material for measurement of the silicon content is accurately weighed and placed in a mold with a diameter of about 5 mm and molded under a pressure of about 10 tons/cm$^2$. Then, the fluorescent X-ray intensity from the magnetic material sample is measured.

In this instance, several molded standard samples having known $SiO_2$ contents have been separately prepared and the fluorescent X-ray intensities therefrom are measured. Then, the silicon content in terms of $SiO_2$ of the objective sample is quantitatively measured by comparing the fluorescent intensity from the objective sample relative to the fluorescent X-ray intensities from the standard samples.

The $SiO_2$ content in the standard samples may be measured according to the weight method of the silicon dioxide quantitative analysis according to JIS K1462-1981.

The aluminum content of the magnetic material used in the present invention may be measured in the following manner.

Into 3 liters of deionized water held at a temperature of 45°–50° C., a slurry of about 25 g of a sample magnetic material dispersed in 400 ml of deionized water is added while being washed with about 328 ml of deionized water. Into the liquid held at 50 ° C. under stirring, 1272 ml of pure-reagent grade hydrochloric acid is added to dissolve the magnetic material until the liquid becomes transparent because of the dissolution of the magnetic material. Then, the liquid is subjected to filtration through a membrane filter with a pore size of 0.1 micron. Then, the aluminum content in the filtrate is measured by ICP (inductively coupled plasma) emission spectroscopy. Herein, the aluminum content thus measured is converted into the content of $Al_2O_3$. Then, the percentage aluminum content may be calculated as follows.

The percentage aluminum content calculated as $Al_2O_3$ (%)=(the $Al_2O_3$ weight calculated from the aluminum weight measured by the ICP emission spectroscopy (g)/sample magnetic material weight (g))$\times$100.

The magnetic developer according to the present invention may preferably be prepared by adding a charge control agent into toner particles (internal addition) or mixing a charge control agent with toner particles (external addition).

Examples of positive charge control agents may include: nitrosine; fatty acid metal salts and modified products thereof, such as aluminum stearate; quaternary ammonium salts, such as tributylbenzylammonium-1-hydroxy-4-naphthyl sulfonate, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclohexyltin borate. These control agents may be used singly or in combination of two or more species. Among these, nigrosine and quaternary ammonium salts are particularly preferred.

Further, homopolymers of a monomer represented by the formula:

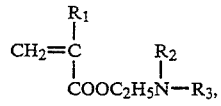

wherein $R_1$ denotes H or $CH_3$; and $R_2$ and $R_3$ denote a substituted or unsubstituted alkyl group (of preferably $C_1$–$C_4$), and copolymers of the monomer with polymerizable monomers, such as styrene, acrylate esters and methacrylate monomers, may also be usable as positive charge control agents. In this case, these control agents can also function as the whole or a part of the binder resin.

Examples of negative charge control agents usable in the present invention may preferably include: metal complexes of monoazo dyes; and metal complexes or salts of organic acids, such as salicylic acid, alkylsalicylic acid, dialkylsalicylic acid and naphthoic acid.

The above-mentioned charge control agent (particularly those not functioning as a binder resin) may preferably be used in particulate form with a preferable number-average particle size of at most 4 microns, particularly at most 3 microns.

In case where the charge control agent is internally added into toner particles to form a magnetic developer, the charge control agent may preferably be used in a amount of 0.1–10 wt. parts, further preferably 0.1–5 wt. parts, per 100 wt. parts of the binder resin.

In case when the charge control is added to toner particles to form a magnetic developer, the magnetic developer may preferably be used in an amount of 0.05–10 wt. parts, particularly 0.3–5 wt. parts, per 100 wt. parts of the binder resin.

The magnetic developer according to the present invention may preferably comprise hydrophobic silica fine powder. Herein, the silica fine powder may comprises anhydrous silica dioxide (silica) and, in addition, any of silicates, such as aluminum silicate, sodium silicate, potassium silicate, magnesium silicate and zinc silicate.

The silica fine powder may provide particularly good results, when it has a specific surface area of 70–300 m$^2$/g as measured by nitrogen absorption according to the BET method. The silica fine powder may preferably be used in an amount of 0.2–1.6 wt. parts, further preferably 0.4–1.6 wt. parts, per 100 wt. parts of the magnetic toner particles.

The silica fine powder is used principally for the purpose of preventing toner wearing and soiling of the sleeve surface. When the magnetic developer according to the present invention is used as a positively chargeable magnetic developer, however, it is preferred that the silica fine powder may also be positively chargeable rather than negatively chargeable so as not to impair the charge stability.

In order to obtain a positively chargeable silica fine powder, the above-mentioned silica fine powder yet-untreated state may for example be treated with a silicone oil having an organo group containing at least one nitrogen atom in its side chain or a nitrogen-containing silane coupling agent, or both of these agents.

On the other hand, in case where the magnetic developer is used as a negatively chargeable magnetic developer, the silica fine powder may preferably have a triboelectric charge of $-100\ \mu C/g$ to $-300\ \mu C/g$. If the triboelectric charge is below $-100\ \mu C/g$, the triboelectric charge of the developer can be decreased and is liable to provide a lower humidity resistance. If the triboelectric charge exceeds $-300\ \mu C/g$, the difficulty of developer-carrying member memory can be promoted, and the developer performance is liable to be affected by deterioration of the silica and thus result in lower performances during continuous use.

Further, a silica fine powder finer than the level of BET specific surface area of 300 $m^2/g$ shows little effect of addition, and a silica fine powder coarser than the level of BET specific surface area of 70 $m^2/g$ is liable to be present in an isolated form, thus causing black spots due to localization or agglomerates of the silica.

The triboelectric charge of the silica fine powder may be measured in the following manner.

0.2 g of silica fine powder which have been left to stand overnight in an environment of 23.5° C. and relative humidity of 60% RH, and 9.8 g of carrier iron powder not coated with a resin having a mode particle size of 200 to 300 mesh (e.g. EFV 200/300, produced by Nippon Teppun K.K.) are mixed thoroughly in a 50 cc wide-mouthed polyethylene bottle having a cap in the same environment as mentioned above (by shaking the pot in hands vertically about 50 times for about 20 see).

Then, about 0.5 g of the shaken mixture is charged in a metal container 2 for measurement provided with 400-mesh screen 3 at the bottom as shown in FIG. 1 and covered with a metal lid 4. The total weight of the container 2 is weighed and denoted by $W_1$ (g). Then, an aspirator I composed of an insulating material at least with respect to a part contacting the container 2 is operated, and the silica in the container is removed by suction through a suction port 7 sufficiently while controlling the pressure at a vacuum gauge 5 at 250 mmHg by adjusting an aspiration control valve 6. The reading at this time of a potential meter 9 connected to the container by the medium of a capacitor having a capacitance C ($\mu$F) is denoted by V (volts.). The total weight of the container after the aspiration is measured and denoted by $W_2$ (g). Then, the triboelectric charge ($\mu C/g$) of the silica is calculated as: $C \times V/(W_1-W_2)$.

The magnetic developer according to the present invention may contain further additives as desired. The colorant may be dyes or pigments known heretofore and may used in an amount of 0.5–20 wt. parts per 100 wt. parts of the binder resin. Examples of other external additives which may be added to the magnetic developer according to the present invention may include: lubricants, such as zinc stearate; abrasives, such as cerium oxide and silicon carbide; fluidity improver and anticaking agents, such as aluminum oxide; and electroconductivity-imparting agents, such as carbon black and tin oxide.

An insulating magnetic toner constituting the magnetic developer according to the present invention may for example be prepared by sufficiently mixing the magnetic material, a vinyl or non-vinyl thermoplastic resin, and optional additives, such as a pigment or dye as a colorant, a charge control agent and other additives in a blender such as a ball mill; and melt-kneading the mixture by a hot-kneading means, such as a hot roller, a kneader an extruder to disperse the magnetic material, etc., in a compatibly kneaded resin; followed by cooling, pulverization, and strict classification.

Figure 2:
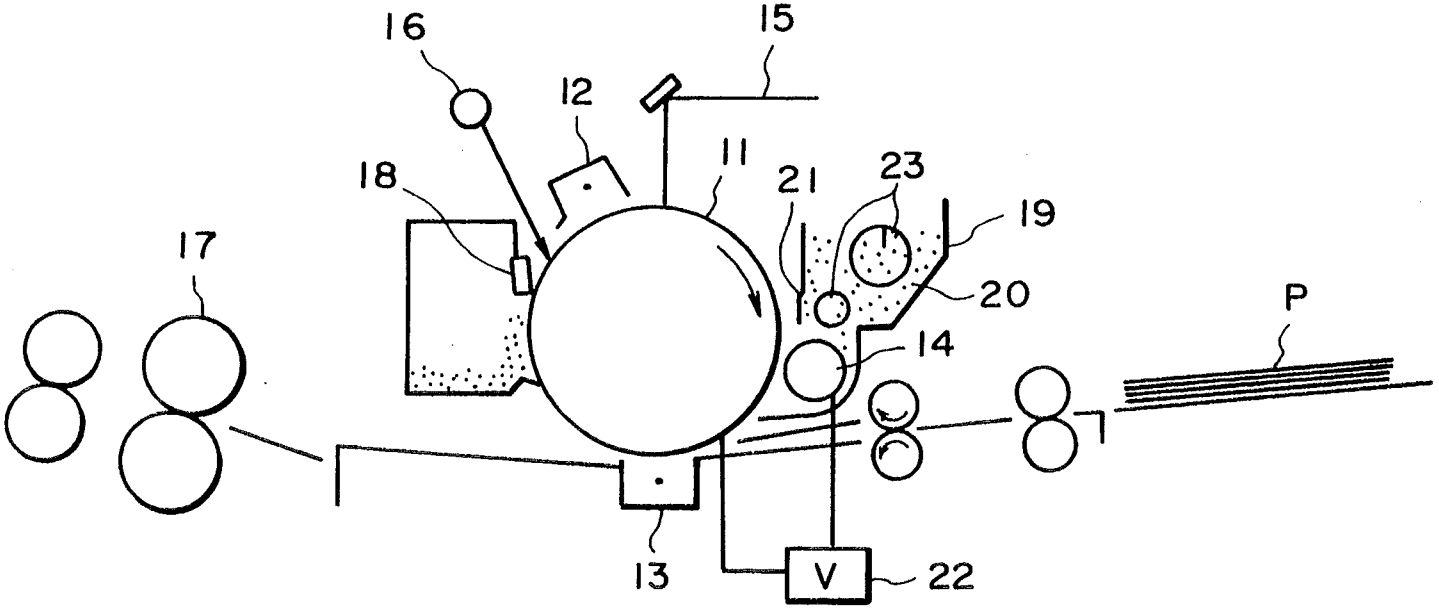
FIG. 2 is a schematic illustration of an embodiment of the electrophotographic apparatus according to the present invention.

Referring to FIG. 2, the image forming apparatus and apparatus unit according to the present invention are explained.

A photosensitive member 11 surface is negatively charged by a primary charger (charging means) 12, subjected to exposure to image light 15 (as by slit exposure or scanning with laser light) to form a digital latent image, and the resultant latent image is reversely developed with a negatively chargeable monocomponent insulating magnetic developer 20 in a developing vessel 19 equipped with a magnetic blade 21 and a developing sleeve 14 containing a magnet therein. In the developing zone, an alternating bias, pulse bias and/or DC bias is applied between the conductive substrate of the photosensitive drum 11 and the developing sleeve 14 by a bias voltage application means 22. When a transfer paper P is conveyed to a transfer zone, the paper is charged from the back side (opposite side with respect to the photosensitive drum), whereby the developed image (toner image) on the photosensitive drum is electrostatically transferred to the transfer paper P. Then, the transfer paper P is separated from the photosensitive drum 11 and subjected to fixation by means of a hot pressing roller fixer 17 for fixing the toner image on the transfer paper P.

Residual monocomponent developer remaining on the photosensitive drum after the transfer step is removed by a cleaner (cleaning means) 18 having a cleaning blade. The photosensitive drum 11 after the cleaning is subjected to erase-exposure by exposure means 16 for discharge and then subjected to a repeating cycle commencing from the charging step by the charger 12.

The electrostatic image-bearing member (photosensitive drum) comprises a photosensitive layer and a conductive substrate and rotates in the direction of the arrow. The developing sleeve 14 comprising a non-magnetic cylinder as a toner-carrying member rotates so as to move in the same direction as the electrostatic image holding member surface at the developing zone. Inside the non-magnetic cylinder sleeve 14, a multi-pole permanent magnet (magnet roll) as a magnetic field generating means is disposed so as not to rotate. The monocomponent insulating magnetic developer 20 stirred by a stirrer 23 in the developing vessel 19 is applied onto the non-magnetic cylinder sleeve 14 and the toner particles are provided with, e.g., a negative triboelectric charge due to friction between the sleeve 14 surface and the toner particles. Further, the magnetic doctor blade 21 of iron is disposed adjacent to the cylinder surface (with a spacing of 50–500 microns) and opposite to one magnetic pole of the multi-pole permanent magnet, whereby the thickness of the developer layer is regulated at a thin and uniform thickness (30–300 microns) which is thinner than the spacing between the electrostatic image bearing-member 11 and the toner carrying member 14 so that the developer layer does not contact the image bearing member 11. The revolution speed of the developing sleeve 14 is so adjusted that the circumferential velocity of the sleeve 14 is substantially equal to or close to that of the electrostatic image bearing member 11. It is possible to constitute the magnetic doctor blade 21 with a permanent magnet instead of iron so as to form a counter magnetic pole. In the developing zone, an AC bias or a pulsed bias may be applied between the developing sleeve 14 and the electrostatic image bearing surface by the biasing means 22. The AC bias may comprise f=200–4000 Hz and Vpp=500–3000 V.

In the developing zone, the magnetic developer particles are transferred to the electrostatic image under the action of an electrostatic force exerted by the electrostatic image bearing surface and the AC bias or pulsed bias.

It is also possible to use an elastic blade of an elastic material, such as silicone rubber, instead of the magnetic iron blade 22, so as to apply the developer onto the developer carrying member and regulate the developer layer thickness by a pressing force exerted by the elastic blade.

In the electrophotographic apparatus, plural members inclusive of some of the above-mentioned members such as the photosensitive member, developing means and cleaning means can be integrally combined to form an apparatus unit so that the unit can be connected to or released from the apparatus body as desired. For example, at least one of the charging means, developing means and cleaning means can be integrally combined with the photosensitive member to form a single unit so that it can be attached to or released from the apparatus body by means of a guide means such as a guide rail provided to the body.

In case where the electrophotographic apparatus is used as a copying machine or a printer, the latent image formation with imagewise light 15 may be performed by exposing the photosensitive drum 11 with reflected light or transmitted light from an original, or with scanning laser beam, light image from an LED array or light image from a liquid crystal shutter array driven based on signals prepared from a read original.

The magnetic developer according to the present invention has the following advantages because it comprises a magnetic material containing silicon and aluminum.

1) The magnetic developer has a large triboelectric chargeability as well as a sharp distribution of triboelectric charge, so that it provides images with excellent thin-line reproducibility, gradation characteristic and resolution.
2) Such images with excellent thin-line reproducibility, gradation characteristic and resolution may be obtained also when latent images are formed based on digital image signals and developed with the magnetic developer according to the reversal development scheme.

Hereinbelow, the present invention will be more specifically described based on Examples, wherein "parts" and "%" used for describing compositions are by weight unless otherwise noted specifically.

Production Example 1–3

Magnetic materials 1–3 having silicon content calculated as $SiO_2$ and aluminum content calculated as $Al_2O_3$ as shown in Table 1 appearing hereinafter were prepared through a wet process wherein ferrous sulfate as a starting material was oxidized in aqueous solution in the presence of sodium silicate and aluminum hydroxide added thereto.

The silicon content and aluminum content were measured according to the fluorescent X-ray analysis and the ICP emission spectroscopy, respectively.

Production Examples 4–6

Magnetic materials 1–3 prepared above were oxidized by 2 hours of aeration with air at 750° C. into materials in the form of $\alpha$-$Fe_2O_3$, which were then aerated for 3 hours with a hydrogen-nitrogen mixture gas to prepare Magnetic materials 4–6 having properties shown in Table 1.

Production Examples 7–9

Magnetic materials 4–6 were subjected to disintegration of agglomerates by means of a fret mill to prepare Magnetic materials 7–9 having properties shown in Table 1.

Production Example 10

Magnetic material 10 having properties shown in Table 10 was prepared through a wet synthesis process wherein ferrous sulfate as a starting material was oxidized in aqueous solution.

TABLE 1

| | Properties | | | | | | | | | | |
|---|---|---|---|---|---|---|---|---|---|---|---|
| Magnetic material | $SiO_2$ (wt. %) | $Al_2O_3$ (wt. %) | Residual magnetization $\sigma_r$ (emu/g) | Coercive force Hc (oersted) | Permeability ($\mu$) | Packed apparent density (g/cm$^3$) | Linseed oil absorption (ml/100 g) | Variation coefficient ($\sigma/x$) × 100 (%) | BET surface area (m$^2$/g) | Average size ($\mu$m) | Long/short axis ratio |
| 1 | 0.72 | 0.29 | 13.5 | 144 | 3.6 | 0.4 | 42 | 29.5 | 8.4 | 0.19 | 1.1 |
| 2 | 0.55 | 0.33 | 13.1 | 150 | 3.7 | 0.6 | 37 | 28.8 | 7.0 | 0.25 | 1.3 |
| 3 | 0.26 | 0.14 | 13.4 | 156 | 3.5 | 0.6 | 36 | 27.6 | 8.7 | 0.27 | 1.0 |
| 4 | 0.71 | 0.28 | 23.7 | 273 | 3.0 | 0.8 | 28 | 26.4 | 6.7 | 0.18 | 1.1 |
| 5 | 0.56 | 0.33 | 15.3 | 163 | 3.8 | 1.1 | 28 | 36.2 | 7.5 | 0.23 | 1.3 |
| 6 | 0.24 | 0.15 | 17.9 | 203 | 3.5 | 0.8 | 28 | 33.1 | 7.9 | 0.26 | 1.0 |
| 7 | 0.71 | 0.28 | 24 | 200 | 3.0 | 1.8 | 16 | 29.7 | 8.5 | 0.17 | 1.1 |
| 8 | 0.55 | 0.32 | 15 | 160 | 3.8 | 1.5 | 22 | 40.1 | 7.3 | 0.21 | 1.3 |
| 9 | 0.26 | 0.14 | 17 | 200 | 3.5 | 1.6 | 19 | 36.5 | 8.0 | 0.24 | 1.0 |
| 10 | 0 | 0 | 7.2 | 87 | 4.6 | 0.5 | 40 | 55.1 | 7.2 | 0.22 | 1.1 |

EXAMPLE 1

| | |
|---|---|
| Magnetic material 8 | 60 parts |
| Styrene-butyl acrylate copolymer (Mw (weight-average molecular weight) = 315,000, copolymerization weight ratio = 82:18) | 100 parts |
| Chromium complex of monoazo dye (negative charge control agent) | 0.5 part |

The above components were melt-kneaded by means of a twin-screw extruder heated up to 130° C., and the kneaded product, after cooling, was coarsely crushed by means of a hammer mill, and then finely pulverized by means of a jet mill. The finely pulverized product was classified by means of a fixed-wall wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a black fine powder (magnetic toner particles) having a volume-average particle size of 11.9 microns. The thus obtained black fine powder showed a triboelectric charge of $-7.3\ \mu C/g$ after mixing with iron powder carrier.

100 parts of the above magnetic toner particles were well blended with 0.5 part of negatively chargeable silica fine powder to obtain Magnetic developer (1).

Magnetic developer (1) prepared was used for image formation by using a laser beam printer ("LBP-8", mfd. by Canon K.K.) to provide clear images with little fog having a high image density of 1.35.

Then, MICR characters were printed on 1000 sheets according to the method of JIS-C6251-1980. The 1000 sheets of MICR print showed a good recognition rate of 88.8% when the MICR characters were magnetized and read by a commercially available reader-sorter ("Model 6780", mfd. by MCR Co.)

EXAMPLE 2

Magnetic developer (2) was prepared in the same manner as in Example 1 except that Magnetic material 5 not subjected to distingration was used instead of Magnetic material 8. As a result of image formation in the same manner as in Example 1. Magnetic developer (2) provided clear images with little fog and having a high image density of 1.30, and also MICR characters which provided a good recognition rate of 84.3%.

EXAMPLE 3

Magnetic developer (3) was prepared in the same manner as in Example 1 except that Magnetic material 9 subjected to distingration was used instead of Magnetic material 8. As a result of image formation in the same manner as in Example 1. Magnetic developer (3) provided clear images with little fog and having a high image density of 1.35, and also MICR characters which provided a good recognition rate of 93.1%.

EXAMPLE 4

Magnetic developer (4) was prepared in the same manner as in Example 1 except that Magnetic material 6 not subjected to distingration was used instead of Magnetic material 8. As a result of image formation in the same manner as in Example 1. Magnetic developer (4) provided clear images with little fog and having a high image density of 1.30, and also MICR characters which provided a good recognition rate of 85.9%.

EXAMPLE 5

Magnetic developer (5) was prepared in the same manner as in Example 1 except that Magnetic material 7 subjected to distingration was used instead of Magnetic material 8. As a result of image formation in the same manner as in Example 1. Magnetic developer (5) provided clear images with little fog and having a high image density of 1.35, and also MICR characters which provided a good recognition rate of 95.4%.

EXAMPLE 6

Magnetic developer (6) was prepared in the same manner as in Example 1 except that Magnetic material 4 not subjected to distingration was used instead of Magnetic material 8. As a result of image formation in the same manner as in Example 1. Magnetic developer (6) provided clear images with little fog and having a high image density of 1.30, and also MICR characters which provided a good recognition rate of 90.8%.

Comparative Example 1

Comparative magnetic developer (1) was prepared in the same manner as in Example 1 except that Magnetic material 10 not subjected to distingration was used instead of Magnetic material 8. As a result of image formation in the same manner as in Example 1. Comparative magnetic developer (1) provided clearly inferior images having a low image density of 1.10, and also MICR characters which provided an inferior recognition rate of 40.6%.

The results of the above Examples 1–6 and Comparative Example 1 are summarized in the following Table 2.

TABLE 2

| | MICR recognition rate (%) | Image density | Thin-line reproducibility* | Disintegration of magnetic material |
|---|---|---|---|---|
| Ex. 1 | 88.8 | 1.35 | B | Yes |
| Ex. 2 | 84.3 | 1.3 | B | No |
| Ex. 3 | 93.1 | 1.35 | A | Yes |
| Ex. 4 | 85.9 | 1.3 | B | No |
| Ex. 5 | 95.4 | 1.35 | A | Yes |
| Ex. 6 | 90.8 | 1.3 | A | No |
| Comp. Ex. 1 | 40.6 | 1.1 | C | No |

Figure 3:
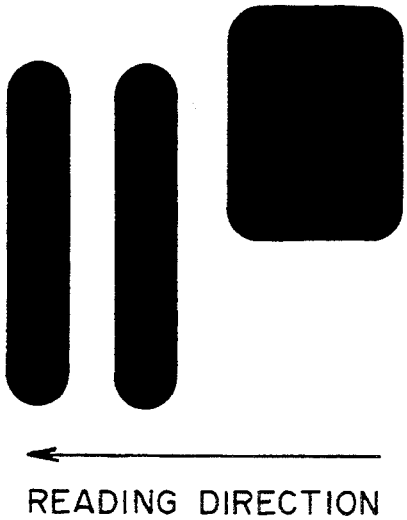
FIG. 3 is an enlarged illustration of a printed ON US signal as an MICR character for evaluating thin-line reproducibility.
Figure 4:
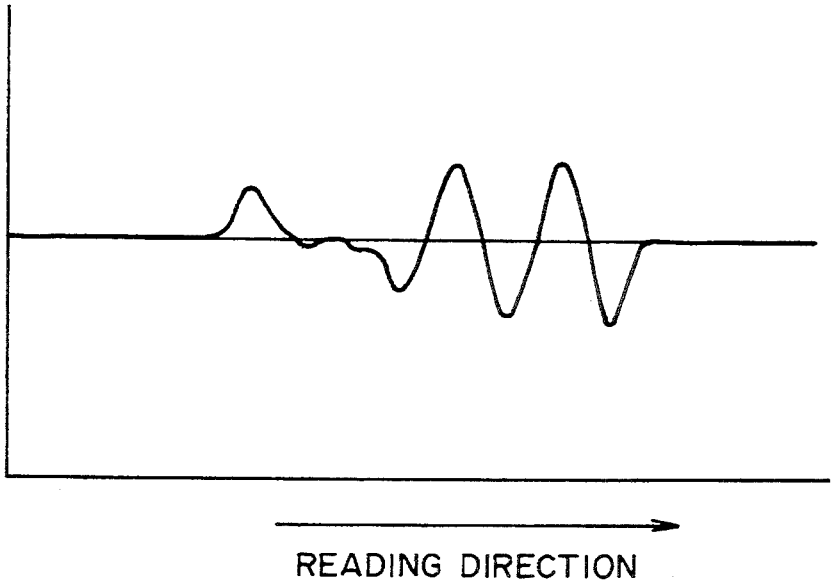
FIG. 4 is a reproduced magnetic signal intensity waveform from the ON US signal shown in FIG. 3.

*For evaluation of the thin-line reproducibility MICR characters were printed according to the standard of JIS-C6251-1980, including an ON US symbol as shown in FIG. 3 as an enlarged view (about 23 times), which symbol provided a magnetic signal intensity waveform, typically as shown in FIG. 4. the thin-line reproducibility was evaluated by observing the enlarged view of printed ON US symbol by naked eyes and observing the degree of disorder of the magnetic signal waveform reproduced by reading in the direction indicated according to the following standards:
A: The reproduced signal waveform was normal and

* For evaluation of the thin-line reproducibility MICR characters were printed according to the standard of JIS-C6251-1980, including an ON US symbol as shown in FIG. 3 as an enlarged view (about 23 times), which symbol provided a magnetic signal intensity waveform, typically as shown in FIG. 4, the thin-line reproducibility was evaluated by observing the enlarged view of printed ON US symbol by naked eyes and observing the degree of disorder of the magnetic signal waveform reproduced by reading in the direction indicated according to the following standards:

A: The reproduced signal waveform was normal and the ON US symbol was printed well according to naked eye observation.

B: The reproduced signal waveform was almost normal and the ON US symbol was printed almost well according to naked eye observation.

C: The represented signal waveform was disordered and the ON US symbol was printed with resolution failure according to naked eye observation.

Production Example 11–13

Three types of magnetic materials were prepared through a wet process wherein ferrous sulfate as a starting material was oxidized in aqueous solution into which varying amounts of sodium silicate and aluminum hydroxide were added. The magnetic materials having different silicon and aluminum contents were respectively oxidized by aeration with air for 2 hours at 750° C. into $\alpha$-$Fe_2O_3$ and then aerated at a lower temperature of 350° C. with a hydrogen-nitrogen mixture for 3 hours to prepare Magnetic materials 11–13 having properties shown in Table 3 appearing hereinafter were prepared.

Production Example 14

Magnetic material 14 containing silicon and having properties shown in Table 3 was prepared through a wet process wherein ferrous sulfate as a starting material was oxidized in aqueous solution into which sodium silicate was added.

Production Example 15

Magnetic material 15 containing aluminum and having properties shown in Table 3 was prepared through a wet process wherein ferrous sulfate as a starting material was oxidized in aqueous solution into which aluminum hydroxide was added.

Production Example 16

Magnetic material 16 having properties shown in Table 3 was prepared through a wet process wherein ferrous sulfate as a starting material was oxidized in aqueous solution.

Then, MICR characters were printed on 1000 sheets according to the method of JIS-C6251-1980. The 1000 sheets of MICR print showed a good recognition rate of 94.0% when the MICR characters were magnetized and read by a commercially available reader-sorter ("Model 6780", mfd. by MCR Co.)

EXAMPLE 8

Magnetic developer (8) was prepared in the same manner as in Example 7 except that Magnetic material 12 was used instead of Magnetic material 11. As a result of image formation in the same manner as in Example 7. Magnetic developer (8) provided clear images with little fog and having a high image density of 1.3, and also MICR characters which provided a good recognition rate of 87.5%.

EXAMPLE 9

Magnetic developer (9) was prepared in the same manner as in Example 7 except that Magnetic material 13 was used instead of Magnetic material 11. As a result of image formation in the same manner as in Example 7.

TABLE 3

| | Properties | | | | | | | | | | |
|---|---|---|---|---|---|---|---|---|---|---|---|
| Magnetic material | $SiO_2$ (wt. %) | $Al_2O_3$ (wt. %) | Residual magnetization $\sigma_r$ (emu/g) | Coercive force Hc (oersted) | Permeability ($\mu$) | Packed apparent density (g/cm$^3$) | Linseed oil absorption (ml/100 g) | Variation coefficient ($\sigma/\bar{x}$) × 100 (%) | BET surface area (m$^2$/g) | Average size ($\mu$m) | Long/short axis ratio |
| 11 | 0.23 | 0.64 | 23.0 | 275 | 3.0 | 1.0 | 33 | 64 | 8.0 | 0.19 | 1.1 |
| 12 | 0.77 | 0.31 | 15.5 | 174 | 3.8 | 0.9 | 35 | 59 | 6.8 | 0.28 | 1.2 |
| 13 | 0.54 | 0.32 | 18.3 | 204 | 3.5 | 0.9 | 34 | 61 | 7.1 | 0.26 | 1.1 |
| 14 | 0.31 | 0 | 5.2 | 56 | 5.4 | 0.6 | 37 | 24 | 8.3 | 0.19 | 1.1 |
| 15 | 0 | 0.12 | 7.6 | 75 | 5.0 | 0.4 | 43 | 42 | 7.0 | 0.24 | 1.1 |
| 16 | 0 | 0 | 8.9 | 92 | 4.7 | 0.7 | 36 | 45 | 7.5 | 0.21 | 1.2 |

EXAMPLE 7

| | |
|---|---|
| Magnetic material 11 | 60 parts |
| Styrene-butyl acrylate copolymer (Mw = 315,000, copolymerization weight ratio = 82:18) | 100 parts |
| Chromium complex of monoazo dye (negative charge control agent) | 0.5 part |

The above components were melt-kneaded by means of a twin-screw extruder heated up to 130° C., and the kneaded product, after cooling, was coarsely crushed by means of a hammer mill, and then finely pulverized by means of a jet mill. The finely pulverized product was classified by means of a fixed-wall wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a black fine powder (magnetic toner particles) having a volume-average particle size of 11.2 microns. The thus obtained black fine powder showed a triboelectric charge of −9.2 $\mu$C/g after mixing with iron powder carrier.

100 parts of the above magnetic toner particles were well blended with 0.5 part of negatively chargeable silica fine powder to obtain Magnetic developer (7).

Magnetic developer (7) prepared was used for image formation by using a laser beam printer ("LBP-8", mfd. by Canon K.K.) to provide clear images with little fog having a high image density of 1.3.

Magnetic developer (9) provided clear images with little fog and having a high image density of 1.3, and also MICR characters which provided a good recognition rate of 92.9%.

Comparative Example 2

Comparative magnetic developer (2) was prepared in the same manner as in Example 7 except that Magnetic material 14 was used instead of Magnetic material 11. As a result of image formation in the same manner as in Example 7. Comparative magnetic developer (2) provided clearly inferior images having a low image density of 1.1, and also MICR characters which provided an inferior recognition rate of 34.3%.

Comparative Example 3

Comparative magnetic developer (3) was prepared in the same manner as in Example 7 except that Magnetic material 15 was used instead of Magnetic material 11. As a result of image formation in the same manner as in Example 7. Comparative magnetic developer (3) provided images having an image density of 1.2 which was somewhat higher than the case using a magnetic material containing no aluminum but was still lower than a practically satisfactory level. Further, the resultant MICR characters provided an inferior recognition rate of 40.1%.

Comparative Example 4

Comparative magnetic developer (4) was prepared in the same manner as in Example 7 except that Magnetic material 16 was used instead of Magnetic material 11. As a result of image formation in the same manner as in Example 7. Comparative magnetic developer (4) provided clearly inferior images having a low image density of 1.1, and also MICR characters which provided an inferior recognition rate of 43.6%.

The results of the above Examples 7–9 and Comparative Examples 2–4 are summarized in the following Table 4.

TABLE 4

| | MICR recognition rate (%) | Image density | Thin-line reproducibility* | Disintegration of magnetic material |
|---|---|---|---|---|
| Ex. 7 | 94.0 | 1.3 | A | No |
| Ex. 8 | 87.5 | 1.3 | B | No |
| Ex. 9 | 92.9 | 1.3 | A | No |
| Comp. Ex. 2 | 34.3 | 1.1 | C | No |
| Comp. Ex. 3 | 40.1 | 1.2 | C | No |
| Comp. Ex. 4 | 43.6 | 1.1 | C | No |

Production Example 17–19

Three types of magnetic materials were prepared through a wet process wherein ferrous sulfate as a starting material was oxidized in aqueous solution into which varying amounts of sodium silicate and aluminum hydroxide were added. The magnetic materials having different silicon and aluminum contents were respectively oxidized by aeration with air for 2 hours at 750° C. into $\alpha$-$Fe_2O_3$ and then aerated at a lower temperature of 350° C. with a hydrogen-nitrogen mixture for 3 hours. The resultant magnetic materials were further subjected to disintegration by a fret mill to prepare Magnetic materials 17–19 having properties shown in Table 5 appearing hereinafter were prepared.

Production Example 20

Magnetic material 20 containing silicon and having properties shown in Table 5 was prepared through a wet process wherein ferrous sulfate as a starting material was oxidized in aqueous solution into which sodium silicate was added.

TABLE 5

| Magnetic material | Properties | | | | | | | | | | |
|---|---|---|---|---|---|---|---|---|---|---|---|
| | $SiO_2$ (wt. %) | $Al_2O_3$ (wt. %) | Residual magnetization $\sigma_r$ (emu/g) | Coercive force Hc (oersted) | Permeability ($\mu$) | Packed apparent density (g/cm$^3$) | Linseed oil absorption (ml/100 g) | Variation coefficient ($\sigma/x$) × 100 (%) | BET surface area (m$^2$/g) | Average size ($\mu$m) | Long/short axis ratio |
| 17 | 0.25 | 0.72 | 23.4 | 268 | 3.0 | 1.8 | 16 | 24.2 | 8.4 | 0.19 | 1.1 |
| 18 | 0.58 | 0.35 | 17.9 | 206 | 3.5 | 1.6 | 19 | 31.1 | 7.9 | 0.20 | 1.1 |
| 19 | 0.77 | 0.30 | 15.7 | 169 | 3.8 | 1.5 | 22 | 27.8 | 7.7 | 0.23 | 1.2 |
| 20 | 0.53 | 0 | 10.2 | 90 | 4.3 | 0.38 | 40 | 29.3 | 6 | 0.3 | 1.1 |

EXAMPLE 10

| | |
|---|---|
| Magnetic material 8 | 60 parts |
| Styrene-butyl acrylate copolymer (Mw = 315,000, copolymerization weight ratio = 82:18) | 100 parts |
| Chromium complex of monoazo dye (negative charge control agent) | 0.5 part |

The above components were melt-kneaded by means of a twin-screw extruder heated up to 130° C., and the kneaded product, after cooling, was coarsely crushed by means of a hammer mill, and then finely pulverized by means of a jet mill. The finely pulverized product was classified by means of a fixed-wall wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a black fine powder (magnetic toner particles) having a volume-average particle size of 12.6 microns. The thus obtained black fine powder showed a triboelectric charge of −8.3 $\mu$C/g after mixing with iron powder carrier.

100 parts of the above magnetic toner particles were well blended with 0.5 part of negatively chargeable silica fine powder to obtain Magnetic developer (10).

Magnetic developer (10) prepared was used for image formation by using a laser beam printer ("LBP-8", mfd. by Canon K.K.) to provide clear images with little fog having a high image density of 1.35.

Then, MICR characters were printed on 1000 sheets according to the method of JIS-C6251-1980. The 1000 sheets of MICR print showed a good recognition rate of 94.8% when the MICR characters were magnetized and read by a commercially available reader-sorter ("Model 6780", mfd. by MCR Co.)

EXAMPLE 11

Magnetic developer (11) was prepared in the same manner as in Example 10 except that Magnetic material 18 was used instead of Magnetic material 17. As a result of image formation in the same manner as in Example 10. Magnetic developer (11) provided clear images with little fog and having a high image density of 1.35, and also MICR characters which provided a good recognition rate of 92.7%.

EXAMPLE 12

Magnetic developer (12) was prepared in the same manner as in Example 10 except that Magnetic material 19 was used instead of Magnetic material 17. As a result of image formation in the same manner as in Example 10. Magnetic developer (12) provided clear images with little fog and having a high image density of 1.35, and also MICR characters which provided a good recognition rate of 89.4%.

Comparative Example 5

Comparative magnetic developer (5) was prepared in the same manner as in Example 10 except that Magnetic material 20 was used instead of Magnetic material 17. As a result of image formation in the same manner as in Example 1. Comparative magnetic developer (5) provided clearly inferior images having a low image density of 1.1, and also MICR characters which provided an inferior recognition rate of 44.7%.

The results of the above Examples 10–12 and Comparative Example 5 are summarized in the following Table 6.

TABLE 6

| | MICR recognition rate (%) | Image density | Thin-line reproducibility* | Disintegration of magnetic material |
|---|---|---|---|---|
| Ex. 10 | 94.8 | 1.35 | A | Yes |
| Ex. 11 | 92.7 | 1.35 | A | Yes |
| Ex. 12 | 89.4 | 1.35 | B | Yes |
| Comp. Ex. 5 | 44.7 | 1.1 | C | No |

Production Example 21–23

Three types of magnetic materials were prepared through a wet process wherein ferrous sulfate as a starting material was oxidized in aqueous solution into which varying amounts of sodium silicate and aluminum hydroxide were added. The magnetic materials having different silicon and aluminum contents were respectively oxidized by aeration with air for 2 hours at 750° C. into $\alpha$-$Fe_2O_3$ and then aerated at a lower temperature of 350° C. with a hydrogen-nitrogen mixture for 3 hours. The resultant magnetic materials were further subjected to disintegration by a fret mill to prepare Magnetic materials 21–23 having properties shown in Table 7 appearing hereinafter were prepared.

Production Example 24

Magnetic material 24 containing silicon and having properties shown in Table 5 was prepared through a wet process wherein ferrous sulfate as a starting material was oxidized in aqueous solution into which sodium silicate was added, and then disintegrating the product from the wet process by a fret mill.

TABLE 7

| Magnetic material | $SiO_2$ (wt. %) | $Al_2O_3$ (wt. %) | Residual magnetization $\sigma_r$ (emu/g) | Coercive force Hc (oersted) | Permeability ($\mu$) | Packed apparent density (g/cm$^3$) | Linseed oil absorption (ml/100 g) | Variation coefficient ($\sigma/\bar{x}$) × 100 (%) | BET surface area (m$^2$/g) | Average size ($\mu$m) | Long/short axis ratio |
|---|---|---|---|---|---|---|---|---|---|---|---|
| | Properties | | | | | | | | | | |
| 21 | 0.15 | 0.39 | 15.9 | 177 | 3.7 | 1.4 | 26 | 39.8 | 7.5 | 0.26 | 1.2 |
| 22 | 0.53 | 0.39 | 16.9 | 192 | 3.5 | 1.3 | 21 | 32.1 | 7.9 | 0.24 | 1.2 |
| 23 | 0.74 | 0.30 | 22.6 | 256 | 3.4 | 1.5 | 23 | 28.4 | 8.4 | 0.18 | 1.1 |
| 24 | 0.53 | 0 | 7.2 | 84 | 5.0 | 1.3 | 28 | 59 | 7.1 | 0.26 | 1.2 |

EXAMPLE 13

| | |
|---|---|
| Magnetic material 8 | 60 parts |
| Styrene-butyl acrylate copolymer (Mw = 315,000, copolymerization weight ratio = 82:18) | 100 parts |
| Chromium complex of monoazo dye (negative charge control agent) | 0.5 part |

The above components were melt-kneaded by means of a twin-screw extruder heated up to 130° C., and the kneaded product, after cooling, was coarsely crushed by means of a hammer mill, and then finely pulverized by means of a jet mill. The finely pulverized product was classified by means of a fixed-wall wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a black fine powder (magnetic toner particles) having a volume-average particle size of 12.3 microns. The thus obtained black fine powder showed a triboelectric charge of −12 $\mu$C/g after mixing with iron powder carrier.

100 parts of the above magnetic toner particles were well blended with 0.5 part of negatively chargeable silica fine powder to obtain Magnetic developer (13).

Magnetic developer (13) thus prepared was used for image formation by using a laser beam printer ("LBP-8", mfd. by Canon K.K.) to provide clear images with little fog having a high image density of 1.35.

Then, MICR characters were printed on 1000 sheets according to the method of JIS-C6251-1980. The 1000 sheets of MICR print showed a good recognition rate of 89.5% when the MICR characters were magnetized and read by a commercially available reader-sorter ("Model 6780", mfd. by MCR Co.)

EXAMPLE 14

Magnetic developer (14) was prepared in the same manner as in Example 13 except that Magnetic material 22 was used instead of Magnetic material 21. As a result of image formation in the same manner as in Example 13. Magnetic developer (14) provided clear images with little fog and having a high image density of 1.35, and also MICR characters which provided a good recognition rate of 91.4%.

EXAMPLE 15

Magnetic developer (15) was prepared in the same manner as in Example 13 except that Magnetic material 23 was used instead of Magnetic material 21. As a result of image formation in the same manner as in Example 10. Magnetic developer (15) provided clear images with little fog and having a high image density of 1.35, and also MICR characters which provided a good recognition rate of 93.8%.

Comparative Example 6

Comparative magnetic developer (6) was prepared in the same manner as in Example 13 except that Magnetic material 24 was used instead of Magnetic material 21. As a result of image formation in the same manner as in Example 1. Comparative magnetic developer (6) provided clearly inferior images having a low image density of 1.2, and also MICR characters which provided an inferior recognition rate of 52.0%.

The results of the above Examples 13–15 and Comparative Example 6 are summarized in the following Table 8.

TABLE 8

| | MICR recognition rate (%) | Image density | Thin-line reproducibility* | Disintegration of magnetic material |
|---|---|---|---|---|
| Ex. 13 | 89.5 | 1.35 | B | Yes |
| Ex. 14 | 91.4 | 1.35 | A | Yes |
| Ex. 15 | 93.8 | 1.35 | A | Yes |
| Comp. | 52.0 | 1.2 | C | Yes |

TABLE 8-continued

| | MICR recognition rate (%) | Image density | Thin-line reproducibility* | Disintegration of magnetic material |
|---|---|---|---|---|
| Ex. 6 | | | | |

Production Example 25–27

Three types of magnetic materials were prepared through a wet process wherein ferrous sulfate as a starting material was oxidized in aqueous solution into which varying amounts of sodium silicate and aluminum hydroxide were added. The magnetic materials having different silicon and aluminum contents were respectively oxidized by aeration with air for 2 hours at 750° C. into $\alpha$-$Fe_2O_3$ and then aerated at a lower temperature of 350° C. with a hydrogen-nitrogen mixture for 3 hours. The resultant magnetic materials were further subjected to disintegration by a fret mill to prepare Magnetic materials 25–27 having properties shown in Table 9 appearing hereinafter were prepared.

Production Example 28

Magnetic material 20 having properties shown in Table 9 was prepared through a wet process wherein ferrous sulfate as a starting material was oxidized in aqueous solution into which sodium silicate was added, and then disintegrating the product from the wet process by a fret mill.

TABLE 9

| Magnetic material | Properties | | | | | | | | | | |
|---|---|---|---|---|---|---|---|---|---|---|---|
| | $SiO_2$ (wt. %) | $Al_2O_3$ (wt. %) | Residual magnetization $\sigma_r$ (emu/g) | Coercive force Hc (oersted) | Permeability ($\mu$) | Packed apparent density (g/cm$^3$) | Linseed oil absorption (ml/100 g) | Variation coefficient $(\sigma/\bar{x}) \times 100$ (%) | BET surface area (m$^2$/g) | Average size ($\mu$m) | Long/short axis ratio |
| 25 | 0.30 | 0.76 | 19.8 | 231 | 3.0 | 1.4 | 22 | 21.3 | 8.2 | 0.21 | 1.0 |
| 26 | 0.78 | 0.28 | 15.1 | 173 | 3.3 | 1.3 | 28 | 28.3 | 7.3 | 0.26 | 1.1 |
| 27 | 0.56 | 0.34 | 16.2 | 184 | 3.5 | 1.3 | 26 | 26.5 | 7.8 | 0.23 | 1.3 |
| 28 | 0 | 0 | 34.1 | 362 | 1.8 | 0.8 | 62 | 78 | 17 | 0.2 | 9.0 |

EXAMPLE 16

| | |
|---|---|
| Magnetic material 8 | 60 parts |
| Styrene-butyl acrylate copolymer (Mw = 315,000, copolymerization weight ratio = 82:18) | 100 parts |
| Chromium complex of monoazo dye (negative charge control agent) | 0.5 part |

The above components were melt-kneaded by means of a twin-screw extruder heated up to 130° C., and the kneaded product, after cooling, was coarsely crushed by means of a hammer mill, and then finely pulverized by means of a jet mill. The finely pulverized product was classified by means of a fixed-wall wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain a black fine powder (magnetic toner particles) having a volume-average particle size of 12.0 microns. The thus obtained black fine powder showed a triboelectric charge of −9.8 $\mu$C/g after mixing with iron powder carrier.

100 parts of the above magnetic toner particles were well blended with 0.5 part of negatively chargeable silica fine powder to obtain Magnetic developer (16).

Magnetic developer (16) thus prepared was used for image formation by using a laser beam printer ("LBP-8", mfd. by Canon K.K.) to provide clear images with little fog having a high image density of 1.35–1.4.

Then, MICR characters were printed on 1000 sheets according to the method of JIS-C6251-1980. The 1000 sheets of MICR print showed a good recognition rate of 94.1% when the MICR characters were magnetized and read by a commercially available reader-sorter ("Model 6780", mfd. by MCR Co.)

EXAMPLE 17

Magnetic developer (17) was prepared in the same manner as in Example 16 except that Magnetic material 26 was used instead of Magnetic material 25. As a result of image formation in the same manner as in Example 16. Magnetic developer (17) provided clear images with little fog and having a high image density of 1.35, and also MICR characters which provided a good recognition rate of 89.2%.

EXAMPLE 18

Magnetic developer (18) was prepared in the same manner as in Example 16 except that Magnetic material 27 was used instead of Magnetic material 25. As a result of image formation in the same manner as in Example 16. Magnetic developer (18) provided clear images with little fog and having a high image density of 1.35, and also MICR characters which provided a good recognition rate of 92.7%.

Comparative Example 7

Comparative magnetic developer (7) was prepared in the same manner as in Example 16 except that Magnetic material 28 was used instead of Magnetic material 25. As a result of image formation in the same manner as in Example 1. Comparative magnetic developer (7) provided clearly inferior images having a low image density of 0.4, and also MICR characters which provided an inferior recognition rate of 38.4%.

Incidentally, the magnetic toner particles obtained in this Comparative Example 7 showed a triboelectric charge of −2.4 $\mu$C/g when measured after mixing with iron powder.

The results of the above Examples 16–18 and Comparative Example 7 are summarized in the following Table 10.

TABLE 10

| | MICR recognition rate (%) | Image density | Thin-line reproducibility* | Disintegration of magnetic material |
|---|---|---|---|---|
| Ex. 16 | 94.1 | 1.35–1.4 | A | Yes |
| Ex. 17 | 89.2 | 1.35 | B | Yes |

TABLE 10-continued

| | MICR recognition rate (%) | Image density | Thin-line reproducibility* | Disintegration of magnetic material |
|---|---|---|---|---|
| Ex. 18 | 92.7 | 1.35 | A | Yes |
| Comp. Ex. 7 | 38.4 | 0.4 | C | Yes |

What is claimed is:

1. A magnetic developer, comprising:

black magnetic toner particles comprising an iron oxide-based magnetic material and a binder, wherein the magnetic material has a silicon content calculated as $SiO_2$ of 0.1 to 1.0 wt. % and an aluminum content calculated as $Al_2O_3$ of 0.1 to 1.0 wt %, respectively, based on the magnetic material, and the magnetic material has a coercive force Hc of 130–300 Oersted and a residual magnetization $\delta_r$ of 12–30 emu/g.

2. The magnetic developer according to claim 1, wherein the magnetic material has been prepared through a wet synthesis process wherein ferrous sulfate is converted into a magnetic material in an aqueous medium and by adding a silicon-containing compound and an aluminum-containing compound during and/or after the wet synthesis process.

3. The magnetic developer according to claim 2, wherein the silicon-containing compound comprises sodium silicate, and the aluminum-containing compound comprises aluminum hydroxide.

4. The magnetic developer according to claim 1, wherein the silicon content and the aluminum content are in a weight ratio of 1:20 to 20:1.

5. The magnetic developer according to claim 1, wherein the magnetic material has a permeability $\mu$ of 2.0–4.0.

6. The magnetic developer according to claim 1, wherein the magnetic material has a residual magnetization $\rho_r$ of 14–28 emu/g, a coercive force Hc of 150–280 Oersted, and a permeability $\mu$ of 2.5 to 3.8.

7. The magnetic developer according to claim 1, wherein the magnetic material has been prepared by oxidizing a magnetic material obtained from ferrous sulfate through a wet process into a form of $\alpha$-$Fe_2O_3$ at a temperature of 600°–900° C. and reducing the form of $\alpha$-$Fe_2O_3$ at a temperature of 250°–450° C.

8. The magnetic developer according to claim 7, wherein the oxidation is performed in an atmosphere of air and the reduction is performed in an atmosphere of a gaseous mixture of hydrogen and nitrogen.

9. The magnetic developer according to claim 1, wherein the magnetic material has been prepared by oxidizing a magnetic material obtained from ferrous sulfate through a wet process into a form of $\alpha$-$Fe_2O_3$ at a temperature of 600°–900° C. and reducing the form of $\alpha$-$Fe_2O_3$ at a temperature of 250°–450° C., so as to provide a residual magnetization $\rho_r$ of 12–30 emu/g, a coercive force Hc of 130–300 Oersted, and a permeability $\mu$ of 2.0 to 4.0.

10. The magnetic developer according to claim 1, wherein the magnetic material has a linseed oil absorption of 5–30 ml/100 g.

11. The magnetic developer according to claim 1, wherein the magnetic material has a packed apparent density of 1.2–2.5 g/cm$^3$.

12. The magnetic developer according to claim 1, wherein the magnetic material has a variation coefficient according to the following equation in the range of 20–50:

$$\text{variation coefficient } (\%) = (\rho/\bar{x}) \times 100,$$

wherein $\bar{x}$ denotes the average particle size of the magnetic material and $\rho$ denotes the standard deviation of the particle size distribution.

13. The magnetic developer according to claim 1, wherein the magnetic material has a variation coefficient according to the following equation in the range of 25–45:

$$\text{variation coefficient } (\%) = (\rho/\bar{x}) \times 100,$$

wherein $\bar{x}$ denotes the average particle size of the magnetic material and $\rho$ denotes the standard deviation of the particle size distribution.

14. The magnetic developer according to claim 1, wherein the magnetic material has been subjected to a disintegration treatment.

15. The magnetic developer according to claim 1, wherein the magnetic material has been subjected to a disintegration treatment to have a linseed oil absorption of 5–30 ml/100 g and a packed apparent density of 1.2–2.5 g/cm$^3$.

16. The magnetic developer according to claim 1, wherein the magnetic material has been subjected to a disintegration treatment to have a variation coefficient according to the following equation in the range of 20–50:

$$\text{variation coefficient } (\%) = (\rho/\bar{x}) \times 100,$$

wherein $\bar{x}$ denotes the average particle size of the magnetic material and $\rho$ denotes the standard deviation of the particle size distribution.

17. The magnetic developer according to claim 1, wherein the magnetic material has a BET specific surface area of 5.0–13.0 m$^2$/g.

18. The magnetic developer according to claim 1, wherein the magnetic material has an average particle size of 0.1–0.6 micron.

19. The magnetic developer according to claim 1, wherein the magnetic material has a long axis/short axis ratio of 1.0–1.5.

20. The magnetic developer according to claim 1, wherein the magnetic toner particles comprise the magnetic material and the binder resin, and the magnetic material is contained in the magnetic toner particles in an amount of 50–140 wt. parts per 100 wt. parts of the binder resin.

21. A magnetic developer according to claim 1, wherein the magnetic toner particles have a resistivity of at least $10^{14}$ ohm.cm under application of a pressure of 3.0 kg/cm$^2$ and a voltage of 100 V.

22. The magnetic developer according to claim 1, which further comprises hydrophobic silica fine powder.

* * * * *

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

ON TITLE PAGE

In [56] References Cited, under OTHER PUBLICATIONS:
"[3066 ," should read --[3066],--.
In [57] ABSTRACT, Line 5:
"respectively" should read --respectively,--.

COLUMN 4

Line 2, "provide" should read --providing--.
Line 63, "desired" should read --desired;--.

COLUMN 7

Line 24, "$\rho_r$" (both occurrences) should read --$\sigma_r$--.
Line 25, "$\rho_r$" should read --$\sigma_r$--.
Line 27, "$\rho_r$" should read --$\sigma_r$--.
Line 34, "$\rho_r$" should read --$\sigma_r$--.
Line 56, "$\rho_r$" should read --$\sigma_r$--.
Line 66, "develop" should read --developer--.

COLUMN 8

Line 21, "magnet" should read --magnetic--.
Line 22, "magnetic" should read --magnet--.
Line 62, "2.58" should read --2.5--.

COLUMN 9

Line 56, "handing" should read --handling--.
Line 60, "may" should read --my--.
Line 61, "$\rho_r$" should read --$\sigma_r$--.
Line 63, "while" should read --will--.

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

COLUMN 10

Line 20, "(ρ" should read --(σ/--.
Line 23, "ρ" should read --σ--.

COLUMN 12

Line 17, "pot" should read --bottle--.
Line 18, "20 sec)." should read --20 sec.--.

COLUMN 13

Line 62, "nitrosine;" should read --nigrosine;--.

COLUMN 14

Line 45, "prises" should read --prise--.

COLUMN 15

Line 32, "pot" should read --bottle-- and "20 see)." should read --20 sec.).--.
Line 38, "aspirator I" should read --aspirator 1--.
Line 53, "used" should read --be used--.

COLUMN 16

Line 2, "kneader an" should read --kneader or an--.

COLUMN 18

Line 3, "Example 1-3" should read --Examples 1-3--.
Line 32, "Table 10" should read --Table 1--.

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

COLUMN 19

Line 27, "distingration" should read --disintegration--.
Line 29, "Example 1. Magnetic" should read --Example 1, Magnetic--.
Line 37, "distingration" should read --disintegration--.
Line 39, "Example 1. Magnetic" should read --Example 1, Magnetic--.
Line 47, "distingration" should read --disintegration--.
Line 49, "Example 1. Magnetic" should read --Example 1, Magnetic--.
Line 57, "distingration" should read --disintegration--.
Line 59, "Example 1. Magnetic" should read --Example 1, Magnetic--.
Line 67, "distingration" should read --disintegration--.

COLUMN 10

Line 1, "Example 1. Magnetic" should read --Example 1, Magnetic--.
Line 9, "distingration" should read --disintegration--.
Line 11, "Example 1. Compara-" should read --Example 1, Compara- --.
Lines 30-35 should be deleted.
Line 57, "Example 11-13" should read --Examples 11-13--.

COLUMN 22

Line 12, "Example 7." should read --Example 7,--.
Line 22, "Example 7." should read --Example 7,--.

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

COLUMN 23

Line 1, "Example 7. Comparative" should read --Example 7, Comparative--.
Line 21, "Example 17-19" should read --Examples 17-19--.
Line 35, "hereinafter were prepared." should read --hereinafter.--.

COLUMN 24

Line 30, "10. Magnetic" should read --10, Magnetic--.
Line 40, "10. Magnetic" should read --10, Magnetic--.
Line 62, "Example 1. Comparative" should read --Example 1, Comparative--.

COLUMN 25

Line 11, "Example 21-23" should read --Examples 21-23--.
Line 25, "hereinafter were prepared." should read --hereinafter.--.
Line 62, "power" should read --powder--.

COLUMN 26

Line 22, "13. Magnetic" should read --13, Magnetic--.
Line 32, "10. Magnetic" should read --10, Magnetic--.
Line 54, "Example 1. Comparative" should read --Example 1, Comparative--.

COLUMN 27

Line 8, "Example 25-27" should read --Examples 25-27--.

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

COLUMN 27

Line 22, "hereinafter were prepared." should read --hereinafter.--.
Line 60, "power" should read --powder--.

COLUMN 28

Line 20, "16. Magnetic" should read --16, Magnetic--.
Line 30, "16. Magnetic" should read --16, Magnetic--.
Line 52, "Example 1. Comparative" should read --Example 1, Comparative--.

COLUMN 29

Line 13, "binder," should read --binder resin,--.
Line 40, "$\rho_r$" should read --$\sigma_r$--.
Line 59, "$\rho_r$" should read --$\sigma_r$--.

COLUMN 30

Line 9, "$\rho$" should read --$\sigma$--.
Line 12, "$\rho$" should read --$\sigma$--.
Line 18, "$\rho$" should read --$\sigma$--.
Line 21, "$\rho$" should read --$\sigma$--.
Line 37, "$\rho$" should read --$\sigma$--.
Line 40, "$\rho$" should read --$\sigma$--.

UNITED STATES PATENT AND TRADEMARK OFFICE

CERTIFICATE OF CORRECTION

PATENT NO. : 5,411,830

DATED : May 2, 1995

INVENTOR(S) : SATOSHI MATSUNAGA

It is certified that error appears in the above-identified patent and that said Letters Patent is hereby corrected as shown below:

COLUMN 30

Line 57, "A" should read --The--.

Signed and Sealed this

Twenty-first Day of November, 1995

Bruce Lehman

*Attest:*

BRUCE LEHMAN

*Attesting Officer*

*Commissioner of Patents and Trademarks*